US008562494B2

(12) United States Patent
Thomas

(10) Patent No.: US 8,562,494 B2
(45) Date of Patent: Oct. 22, 2013

(54) PORTABLE EXERCISE DEVICE AND METHOD OF USING THE SAME

(76) Inventor: Karl Thomas, Scarsdale, NY (US)

( * ) Notice: Subject to any disclaimer, the term of this patent is extended or adjusted under 35 U.S.C. 154(b) by 0 days.

(21) Appl. No.: 13/353,721

(22) Filed: Jan. 19, 2012

(65) Prior Publication Data

US 2013/0190146 A1 Jul. 25, 2013

(51) Int. Cl.
*A63B 21/00* (2006.01)

(52) U.S. Cl.
USPC ..... 482/126; 482/121; 482/907

(58) Field of Classification Search
USPC ..... 482/121, 126, 907
See application file for complete search history.

(56) References Cited

U.S. PATENT DOCUMENTS

| | | | | |
|---|---|---|---|---|
| 1,402,179 | A * | 1/1922 | Piscitelli | 482/124 |
| 2,498,006 | A * | 2/1950 | Ridill | 473/217 |
| 3,815,904 | A * | 6/1974 | Weiss et al. | 482/123 |
| 4,251,071 | A * | 2/1981 | Norton | 482/125 |
| 4,852,874 | A | 8/1989 | Sleichter, III et al. | |
| 5,176,602 | A | 1/1993 | Roberts | |
| D350,795 | S | 9/1994 | Barbour | |
| 5,362,295 | A | 11/1994 | Nurge | |
| 5,405,305 | A | 4/1995 | Wilkinson et al. | |
| 5,431,610 | A * | 7/1995 | Miller | 482/11 |
| 5,584,783 | A | 12/1996 | Hagg et al. | |
| 5,681,248 | A * | 10/1997 | Vani | 482/126 |
| 5,885,196 | A * | 3/1999 | Gvoich | 482/125 |
| 6,110,075 | A | 8/2000 | Woodruff | |
| 6,224,518 | B1 * | 5/2001 | Weiss et al. | 482/93 |
| 6,921,357 | B2 * | 7/2005 | Basting | 482/121 |
| 7,137,935 | B2 * | 11/2006 | Clarke et al. | 482/123 |
| 7,175,574 | B2 | 2/2007 | Carmel et al. | |
| 7,322,907 | B2 | 1/2008 | Bowser | |
| 7,727,131 | B2 | 6/2010 | Longo | |
| 7,775,936 | B2 | 8/2010 | Wilkinson | |
| 7,819,787 | B2 | 10/2010 | Kassel | |
| 2002/0187884 | A1 | 12/2002 | Mcgrath | |
| 2004/0157710 | A1 | 8/2004 | Basting | |
| 2004/0180767 | A1 * | 9/2004 | Carmel et al. | 482/126 |
| 2005/0170937 | A1 | 8/2005 | Van Straaten | |
| 2006/0084556 | A1 | 4/2006 | Payne | |
| 2008/0108486 | A1 | 5/2008 | Vigilia | |
| 2008/0139369 | A1 | 6/2008 | Vigilia | |

FOREIGN PATENT DOCUMENTS

| | | |
|---|---|---|
| KR | 20-0219913 | 4/2001 |

* cited by examiner

*Primary Examiner* — Jerome W Donnelly
(74) *Attorney, Agent, or Firm* — Leason Ellis LLP

(57) ABSTRACT

According to one embodiment, an exercise device in the form of an adjustable resistance multi-use toning system that includes a plurality of elongated elastic bands (tension bands or cables) which can have different tension (resistance) values. Each band has a first end and an opposing second end. The device further includes a hollow sleeve that receives at least a portion of each of the elastic bands so as to at least partially envelope the elastic bands while permitting the first and second ends to be accessible. A first fastener is provided for attaching the first ends of the elastic bands to a support member, such as a piece of exercise equipment, a belt to be worn around a body part of a user; or any other structure to which the exercise device can be attached.

17 Claims, 6 Drawing Sheets

PORTABLE EXERCISE DEVICE AND METHOD OF USING THE SAME

TECHNICAL FIELD

The present invention relates to exercises devices, and, more particularly, to an adjustable resistance multi-use toning system that includes a number of interchangeable parts including one or more elongated resistance bands or cords (cables) that are contained within an elongated sleeve and connectors that permit attachment of the bands to a variety of different support members, including parts of a human body, gym equipment, etc., and allow different accessories to be attached to the bands.

BACKGROUND

As exercising has become more popular, there are more and more different types of exercise devices on the market to meet the needs and desires of individuals. For example, exercise devices can range from small portable devices to large fixed structures and also can be designed to exercise a specific body part or provide the user with an entire body workout.

Many of these systems provide satisfactory results; however, they also have associated disadvantages including size, bulkiness, and limitations on the number and variety of exercises possible. Further, the devices can be very expensive and complex to assemble and use. In clinical and in home settings, it is often not desirous to occupy a room with large exercise equipment.

There is therefore a need for an exercise device that can be easily customizable and attached and secured to any number of different support members, including a piece of exercise equipment or a body part, thereby offering the user not only the ability to use the exercise equipment but also perform physical toning exercises and the like at the same location and in some instances at the same time. The exercise devices of the present invention provide a solution to this need.

SUMMARY

According to one embodiment, an exercise device in the form of an adjustable resistance multi-use toning system that includes a plurality of elongated elastic bands (tension bands or cables) which can have different tension (resistance) values. Each band has a first end and an opposing second end. The device further includes a hollow sleeve that receives at least a portion of each of the elastic bands so as to at least partially envelope the elastic bands while permitting the first and second ends to be accessible.

A first fastener is provided for attaching the first ends of the elastic bands to a support member, such as a piece of exercise equipment, a belt to be worn around a waist of a user or other body part; or any other structure to which the exercise device can be attached. The first fastener is openable and closeable and is adjustable along at least one dimension so as to permit the first fastener to attach to different sized support members. The first fastener is detachably coupled to the first ends of the elastic bands and an accessory, such as a handle, bar, belt, ankle or foot band, etc., is attached to the second end of at least one of the elastic bands. The first fastener can be in the form of a length of material that has fasteners (e.g., pieces of hook and loop material) at the ends thereof to permit the first fastener to be attached around the support member. The attachment between the first fastener and the first ends is of a dynamic nature to allow the bands to freely pivot and move relative to the first fastener.

In one embodiment, the sleeve is openable along its length to allow the easy insertion and removal (in a lateral direction) of all or any of the elastic bands. For example, the sleeve can include a longitudinal slit that defines two opposing edges that include fastening elements (e.g., snaps, button, hook and loop material, etc.) that permit the sleeve to be sealingly closed around the elastic bands, thereby containing the bands therein and prevent the bands from interfering with the user and/or the exercise equipment to which the device is attached in one embodiment.

The accessory can be in the form of a handle that is fixedly attached to the second end of one or more elastic band and is not removable therefrom or the handle can be of a detachable type and include a coupling member to permit the handle to attach to more than one elastic band.

Other aspects, features and advantages of the invention will be apparent in view of the accompanying description of certain embodiments thereof when considered in connection with the accompanying drawing figures.

DETAILED DESCRIPTION OF CERTAIN EMBODIMENTS

Figure 1:
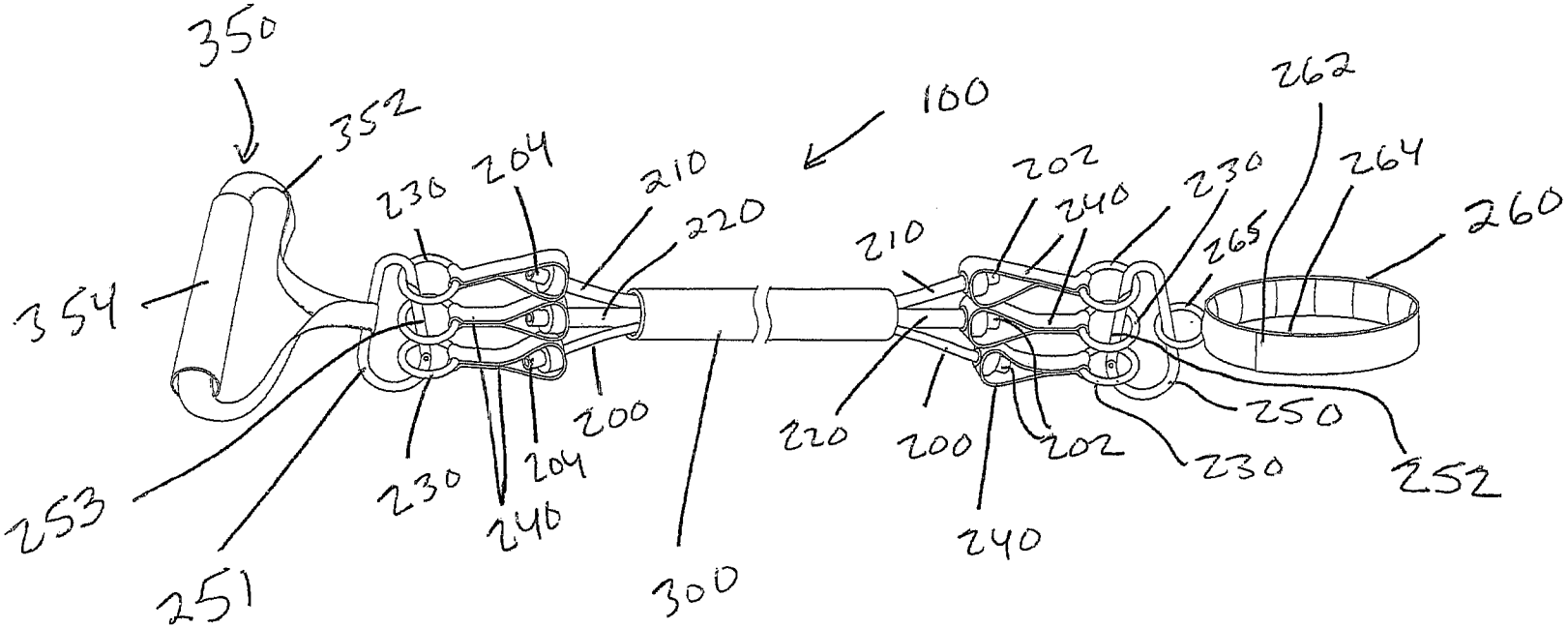
FIG. 1 is a perspective view of a portable modular exercise device according to one embodiment of the present invention.
Figure 5:
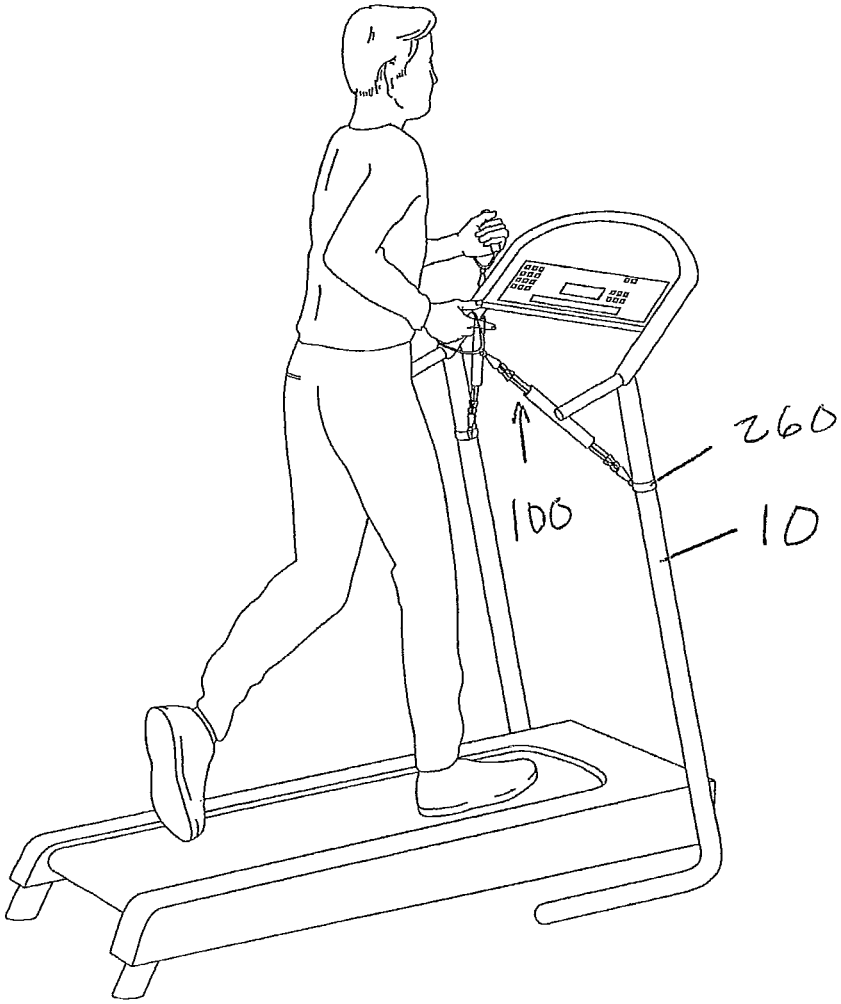
FIG. 5 is a perspective view of the portable modular exercise device of FIG. 1 attached to a piece of exercise equipment to provide an adjustable resistance, cardio and resistance toning workout for a user.

FIGS. 1 and 5 illustrate one embodiment of an exercise device 100 incorporating features of the present invention. The exercise device 100 can be thought of as being an adjustable resistance multi-use toning system that can be used by a user in any number of different settings to perform any number of different exercises. More specifically and as described in detail below, the device 100 is configured to be used as an add-on (accessory) to other exercise devices, routines and methods. The device 100 increases the level of cardio workout (more calories consumed, easier to reach and maintain target heart rate) when used in conjunction with other exercise devices, routines and methods. The device 100 adds resistance training/muscle toning to a workout when used with other exercise devices, routines and methods. However, the device 100 can also be used as a standalone exercise device, without other exercise devices, routines and methods.

In accordance with the present invention, the exercise device 100 includes a number of complementary parts that mate together to form one of many different assembled states of the exercise device 100. The exercise device 100 includes a means for providing variable resistance to exercises such as an elastic band or cord (such as the ones commonly referred to as a resistance band or cable). Multiple resistance bands can be used to provide additional resistance to exercises and to alter the degree of resistance encountered by the user. In the Figures, the resistance bands are numbered 200, 210, 220 in the situation where up to three bands 200, 210, 220 are used. However, it will be appreciated that more than three or less than three resistance bands can be used in the practice of the present invention as will be appreciated by the following discussion. In other words, a single band can be used, two bands can be used or three or more can be used.

Though one embodiment of the exercise apparatus 100 uses elastic tubing for the resistance bands 200, 210, 220, it should be understood that one of skill in the art would recognize that any of a number of other materials could be used as a means for providing resistance to exercises, such as bungee cords, elastic bands, etc. Thus, the resistance bands 200, 210, 220 can be any commercially available rubber resistance tubes or any similar structure that can be elongated and offers resistance.

As also described herein, the exercise device 100 of the present invention can be provided with sets of multiple sized (multiple lengths) resistance bands 200, 210, 220 to allow the user to change the resistance bands based on the particular application (exercise) of the exercise device 100 and based on anatomical considerations of the user.

In the embodiment shown, the resistance bands 200, 210, 220 are made up of three elastic tubes of differing thickness and resistance which range, for example, from light to heavy. Resistance bands 200, 210, 220 that utilize a wide range of tubing thicknesses allow the doctor, therapist, trainer, or user to easily tailor the amount of resistance applied for each exercise. This ability to easily switch from light to heavy or any combination of resistance bands 200, 210, 220 is one of the advantages and features of the present product 100. It should be understood by one of skill in the art that any number of resistance bands can be used and any combination of resistance bands can be used to vary the resistance for exercises. Another advantage of the present invention is that the user can change one or more of the bands while the exercise device is being used by the user without the need to stop exercising as is the case with other devices. For example, a user can add a band to increase resistance as the user continues to exercise.

Each of the resistance bands 200, 210, 220 includes a first end 202 and an opposing second end 204. As will be appreciated herein, the first end 202 is designed to be coupled to a support structure 10 which can either in the form of a fixed member, such as a piece of exercise equipment or other support structure or alternatively, the support structure 10 can be in the form of a body part, such as an ankle, foot, etc. The opposite end 204 is intended to be grasped, directly or indirectly, by the user to perform the resistance (toning) exercise.

At the first end 202 of each resistance band 200, 210, 220 is a first connector or coupling member 230. The first connector or coupling member 230 can be any number of types of connectors that allow connection or coupling between the end 202 and another object. In the illustrated embodiment, the first connector 230 can be in the form of a ring shaped connector that is fixedly attached to the end 202. In the illustrated embodiment, the first connector 230 can be in the form of a ring (e.g., circular ring or D-shaped metal ring or plastic ring) that is attached to the end 202 either directly or by means of an intermediate connector 240 such as a strap (e.g., nylon strap) that is connected to the end 202 and has the ring 230 captured therein. It will be appreciated that the illustrated first connector 230 is merely one type of connector and it is within the scope of the present invention that other types of connectors can equally be used. The first connector 230 provides a means for connecting the individual bands 200, 210, 220 to another object as described herein.

The first connectors 230 at each of the first ends 202 provide a means for connecting the ends 202 to the support structure 10. In the illustrated embodiment, a first fastener or carabiner 250 is provided as part of the connection system for securely connecting the first ends 202 to the support structure 10. As is known, a carabiner 250 is a metal loop with a sprung swinging gate 252 that allows a member to be received within and along the loop. The first carabiner 250 can be opened by opening the gate 252 and the first connectors 230 associated with the bands 200, 210, 220 are received therein to securely attach the bands 200, 210, 220 to the first carabiner 250 when the gate 252 is closed.

Alternatively, each first end 202 can include a first carabiner 250 to permit direct attachment to another structure.

Another part of an exemplary connection system is an adjustable fastener or coupling member 260 that is constructed to securely receive and be coupled to the support structure 10.

In one illustrated embodiment, the adjustable fastener 260 is in the form of an elongated strip of flexible material that forms a band (e.g., fabric band) that can be attached about the support structure 10 and secured thereto.

The fastener 260 can be a strip of fabric (e.g., nylon) that is easily foldable and can be attached about the support structure 10. The fastener 260 has a first end 262 and an opposing second end 264, with the ends being constructed to attach to one another in a releasable manner. At the first and second ends 262, 264, hook and loop material can be provided to allow attachment of the first end 262 to the second end 264 by intimately contacting the ends to one another.

The fastener 260 is thus of the type that can be fully opened so as to receive the support structure 10 within the open fastener 260 and then permit fastener 260 to be closed about the support structure. To secure the fastener 260 to the support structure 10, the fastener 260 (strap) is opened and then the strap is wrapped tightly around the support structure 10 and securely attached to itself by means of the hook and loop material.

The fastener 260 includes an integral coupling member 265 that allows the fastener 260 to be attached to the first (fastener) carabiner 250 similar to how the rings 230 mate with the first carabiner 250. As illustrated, the coupling member 265 can be in the form of a metal ring or the like that allows the fastener 260 to easily be attached and detached from the bands 200, 210, 220. When each first end 202 has a carabiner 250, the carabiner 250 mates with the member 265.

Similarly, at each of opposite second ends 204 of the bands 200, 210, 220, connector or coupling members are disposed to allow an accessory (as described below) to be attached thereto. In one embodiment, as shown, the connectors can be in the form of the connectors 230. In the illustrated embodiment, the first connector 230 is in the form of a ring shaped connector that is fixedly attached to the end 204. The first connectors 230 are attached to the end 204 either directly or by means of an intermediate connector 240 (as shown) such as a strap (e.g., nylon strap) that is connected to the end 204 and has the ring 230 captured therein. The first connector 230 provides a means for connecting the individual bands 200, 210, 220 to the user accessory as described herein.

The first connectors 230 at each of the second ends 204 provide a means for connecting the ends 204 to the support structure 10. In the illustrated embodiment, a second fastener or carabiner 251 is provided as part of the connection system for securely connecting the second ends 204 to a user accessory 350. The carabiner 251 is a metal loop with a sprung swinging gate 253 that allows a member to be received within and along the loop. The second carabiner 251 can be opened by opening the gate 253 and the connectors 230 associated with the bands 200, 210, 220 are received therein to securely attach the bands 200, 210, 220 to the second carabiner 251 when the gate 253 is closed.

The user accessory 350 is a component that can be grasped by the user to allow extension of the bands 200, 210, 220 by pulling the accessory 350 outwardly. In the illustrated embodiment, the accessory 350 is in the form of a handle that can be easily grasped by the user to allow the user to extend the bands 200, 210, 220 by pulling the second ends 204 outwardly, while the other ends 202 of the bands are securely fixed to the support structure 10.

The handle 350 can include a fabric strip 352 forming a loop and a tubular hand grip 354 constructed of a polymeric material and disposed about the strip 352. It will be appreciated that the illustrated handle 350 is merely one exemplary type of handle and any number of different types of handles can be used and designed to be held by the user. The handle 350 is coupled to the ends 204 of the bands 200, 210, 220 by means of the second carabiner 251.

The handle 350 construction permits the user to vary the degree of total resistance offered by the bands 200, 210, 220 by allowing the user to easily select which of the bands 200, 210, 220 are attached to the handle 350 by being securely captured within the same second carabiner 251 that captures the handle 350. For example, the user can attach one of the bands 200, 210, 220 to the second carabiner 251 or the user can select and attach two or more of the bands 200, 210, 220 to the second carabiner 251. In the illustrated embodiment, the band 200 is intended to offer the least resistance (light); the band 210 offers an intermediate level of resistance (medium); and the band 220 offers the greatest level of resistance (heavy). It will therefore be appreciated that the total resistance can easily be varied by combining different bands 200, 210, 220 due to each band having a different level of resistance. Thus, the combination of bands 200, 210 offers less resistance than the combination of bands 210, 220, etc. The design of the present product allows for the user to easily be able to change the level of resistance. The resistance can also be varied by adding or subtracting bands that each has the same resistance value in the case in which all of the bands have the same resistance value.

It will be understood that the elastic bands used in the present device can be all of the same resistance value in which case, the more bands that are attached to the accessory, such as a handle, increases the resistance. It will also be understood that the term accessory encompasses any member that is responsive to user movement and engages the band(s) to provide a workout to the user. For example and as described herein, the accessory can be a handle; bar; belt; loop; rope; ankle, leg or foot member, etc.

It will be appreciated that the handle 350 is thus constructed to allow the different bands to be easily connected thereto.

Other coupling arrangements are equally possible for attaching the handle to the second end of one or more of the bands.

In accordance with the present invention, the bands 200, 210, 220 are routed through a common sleeve or casing 300. The sleeve 300 is open at both ends to permit the bands 200, 210, 220 to be routed through the sleeve 300 and protrude from the opposite ends of the sleeve 300. The bands 200, 210, 220 can freely move within the hollow interior of the sleeve 300; however, the bands 200, 210, 220 preferably are intimately fit within the sleeve 300 so as to prevent the bands 200, 210, 220 from freely falling out of the sleeve 300.

The sleeve 300 thus has a construction that maintains the bands 200, 210, 220 in place within a common structure or casing. This prevents the bands from getting in the way of a surrounding object, such as exercise equipment. In the embodiment of FIG. 1, the sleeve 300 has a tubular structure and is formed of a polymeric material or rubber material, or any other suitable material. To insert or remove one or more bands, 200, 210, 220, the respective bands 200, 210, 220 are simply pulled through the sleeve 300 from one end thereof.

The sleeve 300 also provides the advantage that the bands 200, 210, 220 are constrained along a substantial portion of their lengths so as to prevent the bands 200, 210, 220 from interfering with the exercise routine of the user. The sleeve 300 also provides a level of padding and shields the user from the moving bands and also from the equipment (support structure).

FIG. 5 shows the device 100 attached to a piece of exercise equipment 10, in this case a treadmill, by attaching the fastener 260 to a generally vertical frame member of the equipment 10. However, it will be understood that the device 100 can equally be attached to a horizontal support structure, such as a horizontal frame member or bar and generally can be attached to any type of fixed support structure, including knobs, hooks, bars, beams, etc. regardless of the orientation thereof.

The opposite end, including the handle 350, is free to be grasped by the user to allow the user to freely and easily exercise while still standing on the treadmill 10. It will be appreciated that the user can exercise while the treadmill is not operating and the user simply is standing on the treadmill and in accordance with one of the main advantages of the present invention, the user can supplement one form of exercise by using the exercise device. In other words, the one form of exercise can be jogging on a treadmill and the supplemental form of exercise is a toning workout using the exercise device. The term supplemental is not limiting since the toning workout may be more strenuous than the underlying exercise, such as a walk on the treadmill.

Figure 2:
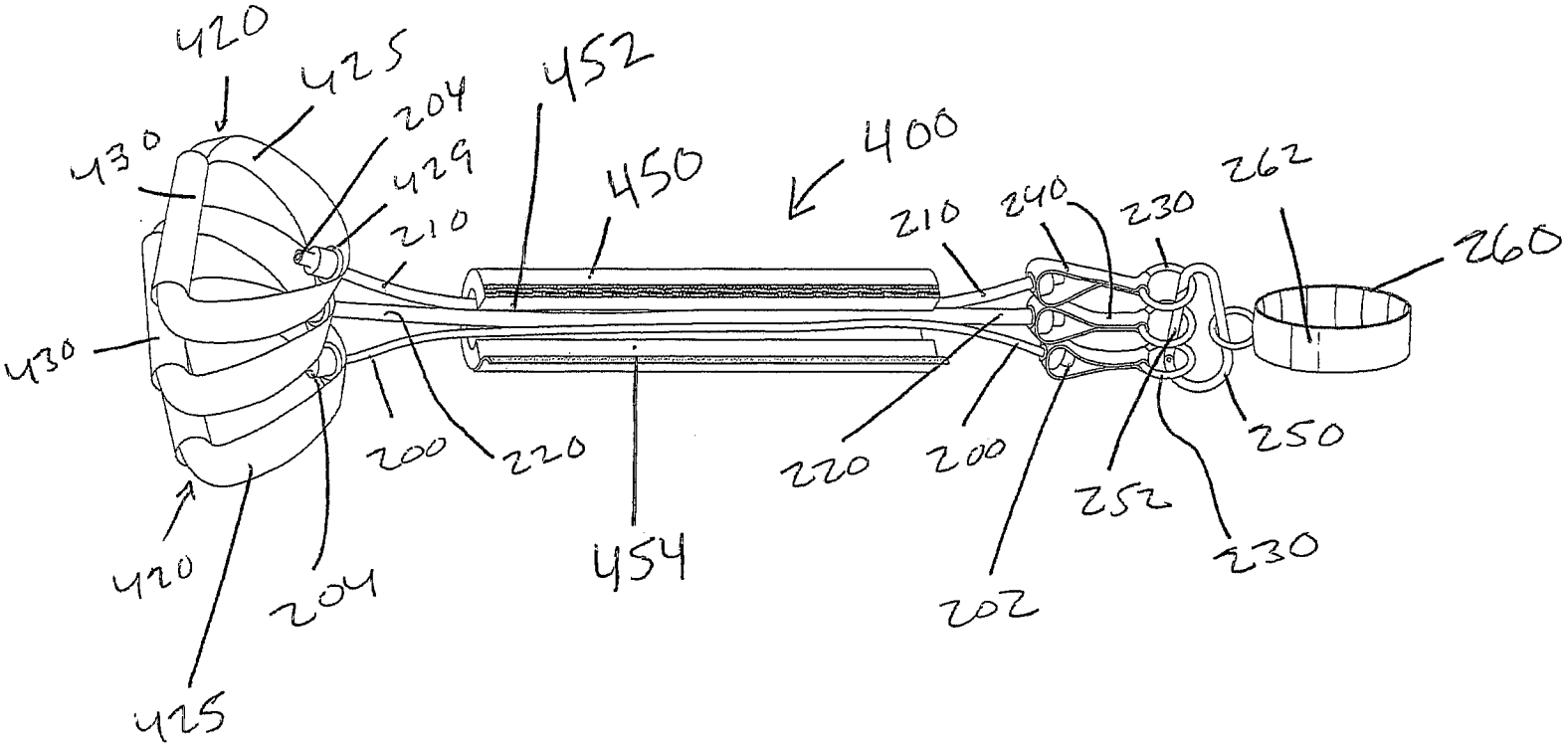
FIG. 2 is a perspective view of a portable modular exercise device according to another embodiment of the present invention.

FIG. 2 shows a device 400 that is very similar to the device 100 and therefore, like elements are numbered alike.

In this embodiment, each band 200, 210, 220 includes its own associated fixed handle 420. The handle 420 includes a fabric strip 425 forming a loop and defining a hole receiving one of the bands 200, 210, 220; a grommet 429 disposed about the hole and a tubular hand grip 430 disposed about the strip 425. The handle 420 is thus fixedly attached to the respective band 200, 210, 220 and is not removable therefrom. The user can vary the resistance of the workout by simply grasping a different band and/or by grasping more than one handle.

The device 400 includes a sleeve 450 that is openable along its length. In particular, the sleeve 450 includes a first longitudinal edge 452 and an opposing longitudinal edge 454 that are constructed to fasteningly attach to one another so as to form a closed tubular structure. For example, the first and second edges 452, 454 can include hook and loop material to permit the edges 452, 454 to mate together and attach to one another to form the closed structure.

This type of openable sleeve 450 allows the bands 200, 210, 220 to be easily inserted and removed therefrom by opening the sleeve 450 along its edges 452, 454 and then laterally inserting or removing the bands 200, 210, 220. The sleeve 450 thus resembles a clamshell type casing the opens along a living hinge.

The sleeve 450 can be formed of any number of different materials including polymeric materials, etc. In the illustrated embodiment, the sleeve 450 is formed of a fabric material (e.g., nylon) as an outer shell and has padding therein to provide not only thickness to the sleeve 450 but also to provide comfort in case a body part, such as a limb, of the user contacts the sleeve 450 during exercise. The padding can be contained within the sleeve such as by stitching, etc. The strips of hook and loop material are located along the edges 452, 454. The sleeve 300 also can be formed to provide padding to the user similar that described above and in any event, the sleeve 300 shields the user from the working elastic bands that are moving, etc.

It will also be appreciated that other types of fasteners can be used to attach the edges 452, 454 to one another to form a closed structure in which the bands nest. For example, suitable fasteners can include but are not limited to a zipper, snaps, buttons, etc.

The slit or opening formed in the sleeve 450 and the fastener features, in this case the hook and loop material, also allows the diameter (circumference) of the sleeve 450 to change and thus, a tight wrap can be formed around the bands 200, 210, 220 regardless of whether there are 1, 2, 3 or more bands and also regardless of the individual diameters of the bands. By wrapping the sleeve 450 around the bands until an intimate fit is formed and then fastening the edges 452, 454 together, the bands are fully contained within the sleeve such that lateral movement is limited; however, each band can freely undergo elongation and retraction as the user manipulates the bands themselves.

It will be fully understood and appreciated that the various components shown in the embodiments of FIGS. 1 and 2 can be readily interchanged. For example, the sleeve 450 of FIG. 2 can be used in the device 100 instead of the sleeve 300; the bands 200, 210, 220 of device 100 can of the type that includes individual fixed handles 420 as in FIG. 2; the bands of the device 400 of FIG. 2 can include the connectors and handles 350 shown in FIG. 1 and can include the sleeve 300; etc. The modular aspect of the devices disclosed herein allows individual parts to be readily changed to allow the user to customize and create exercise devices having different constructions. This allows an individual to customize the exercise device.

The various components described and illustrated herein can be provided in a kit or the like to allow a user the ability to customize the product based on any number of different considerations including but not limited to personal needs and also based upon the manner in which the product is secured to another object, etc.

Figure 3:
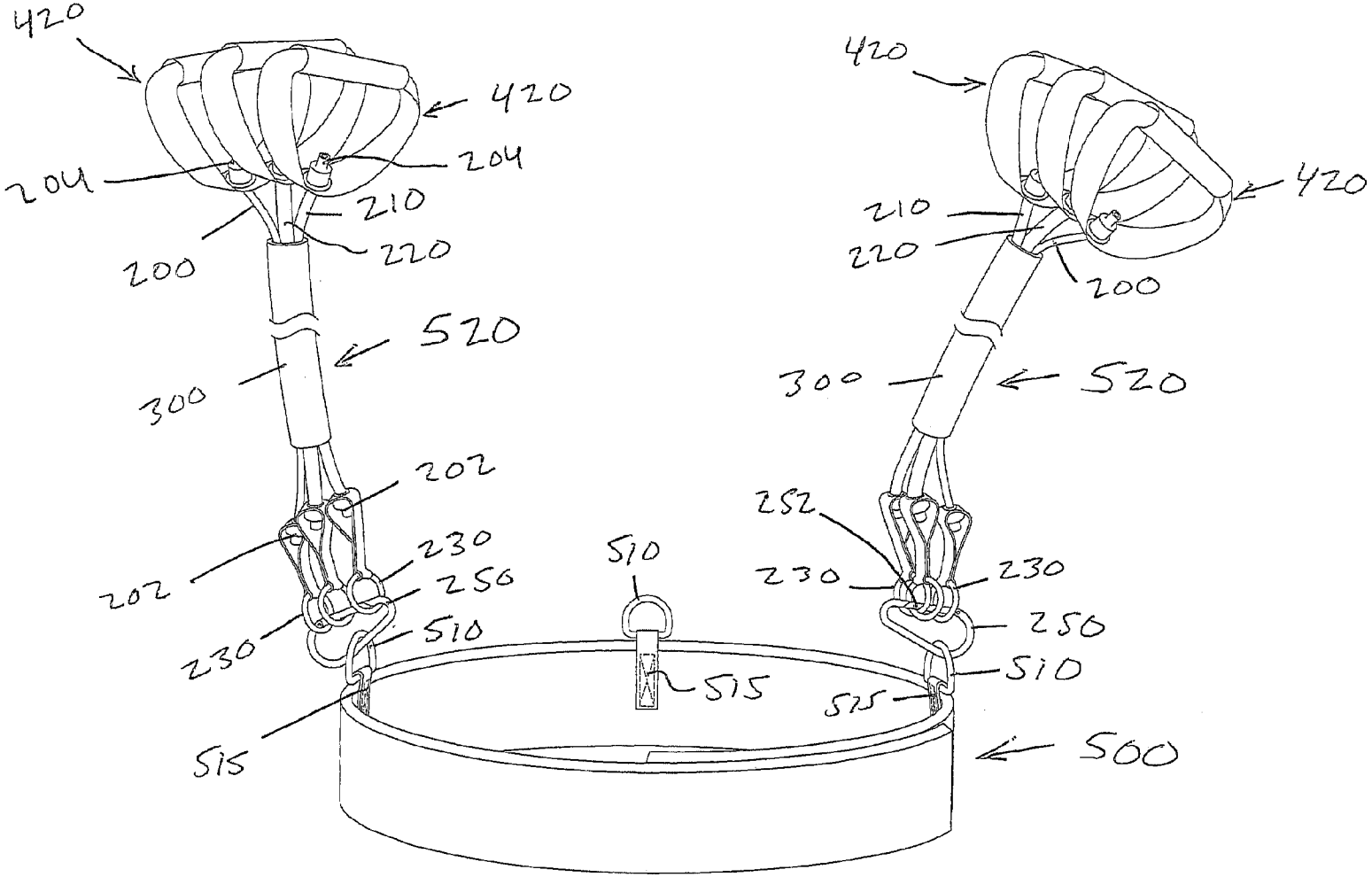
FIG. 3 is a perspective view of a portable modular exercise device according to another embodiment of the present invention.

FIG. 3 shows yet another embodiment in which a belt 500 serves as the support structure to which one end the exercise device according to the present invention is attached. The belt 500 can be in the form of a workout belt that is attached around a user's waist or around any other part of the user's body including but not limited to any limb, chest, head, etc., depending upon the exercise to be performed. For example, if a true sparring (boxing) experience is desired, the user can place the belt around the chest and then grasp the handles (accessories). Thus, true sparring action can be achieved when the belt is up on the chest so that the force of the "punches" comes from the shoulder and not the waist.

It will be understood that the belt 500 can be adjusted and slid up and down the body so that the angle of the bands can be adjusted. By moving the belt up and down the body, including thighs, different angles of movement of the resistance bands are achieved and different muscle groups can be exercised.

The belt 500 has two free ends that are attached to one another to form a snug fit around the user's waist. The belt 500 allows a user to walk or jog or otherwise exercise (including stationary exercise), while at the same time a resistance/muscle toning workout can be achieved with the exercise device.

The belt 500 also includes at least one and preferably a plurality of coupling members 510 that allow one or more exercise devices 520 according to the present invention to be attached thereto at one end thereof. The devices 520 of FIG. 3 are very similar to the devices 100, 400 and include three bands 200, 210, 220 encased within a sleeve 300 with fixed handles 420 at second ends 204 of each of the respective bands 200, 210, 220. The first ends 202 include coupling members 230 that are attached to the first carabiner 250. The coupling member 510 of the belt 500 can be in the form of a ring (e.g., metal D-ring) that is attached to the body of the belt 500 using a strap 515 or the like. The pivoting between the member 510 and the strap 515 allows the attached device 520 to have enough movement to allow the user to perform exercises, etc.

As in all of the embodiments disclosed herein, the number of elastic bands used in the exercise device can be 1, 2 or 3 or more.

To attach the device 520 to the belt 500, the user simply presses down the gate 252 of the first carabiner 250 and then inserts the coupling member 510 therein such that it is securely captured by the first carabiner 250. The end of the device 520 that is attached to the belt 500 thus represents the attached or fixed end of the device and the user grasps the handles 420 at the opposite end with his or her hand and then begins exercising as by pulling the handles 420 outwardly, etc. It will be understood that a leg band or foot band can also be used instead of a handle for grasping by a hand.

While FIG. 3 shows two of the same type of devices 520 being attached to the belt 500, it will be appreciated that two or more different types of exercise devices, similar or identical to devices 100, 400, 520 can be attached to the belt 500. This type of arrangement is beneficial when there is a lack of a support structure, like exercise equipment 10, to attach the device to, or when the device is used outside or in conjunction with walking, running, sparring, etc. As with the other embodiments, the user can easily interchange the different components that form the devices 520 so as to create a custom exercise device that is configured for attachment to the belt 500. The handles can thus be of a detachable type (FIG. 1) and are not limited to being fixed as shown.

Figure 4:
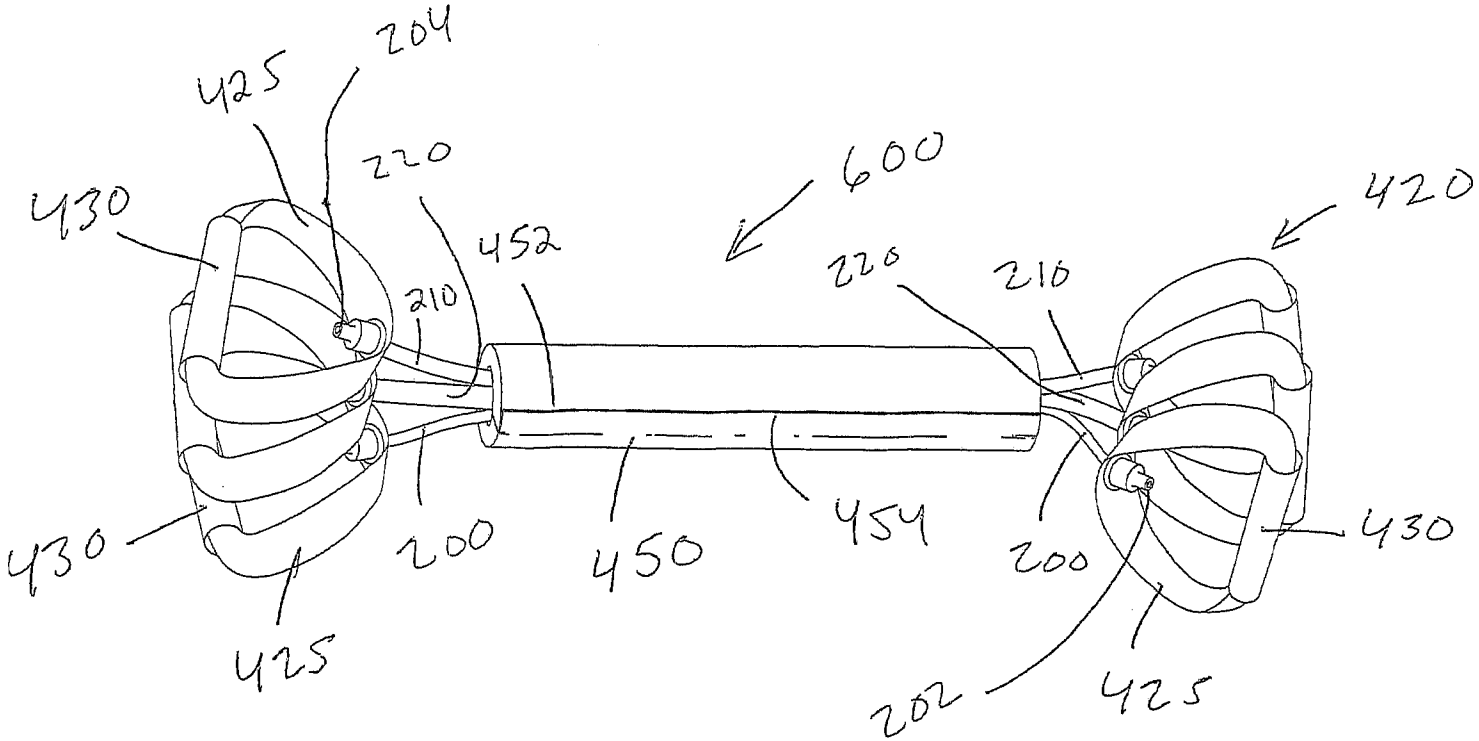
FIG. 4 is a perspective view of a portable modular exercise device according to yet another embodiment of the present invention.

FIG. 4 shows another embodiment of an exercise device 600 that includes components that were part of the devices previously described herein. In particular, the exercise device 600 includes the sleeve 450 that is openable along the edges 452, 454 and is fastenable therealong by means of a fastener, such as a hook and loop material or other fastener, such as a zipper, snaps, button, etc. At each of the ends 202, 204, the respective bands 200, 210, 220 include fixed handles 420 which have a construction previously described herein.

Figure 6:
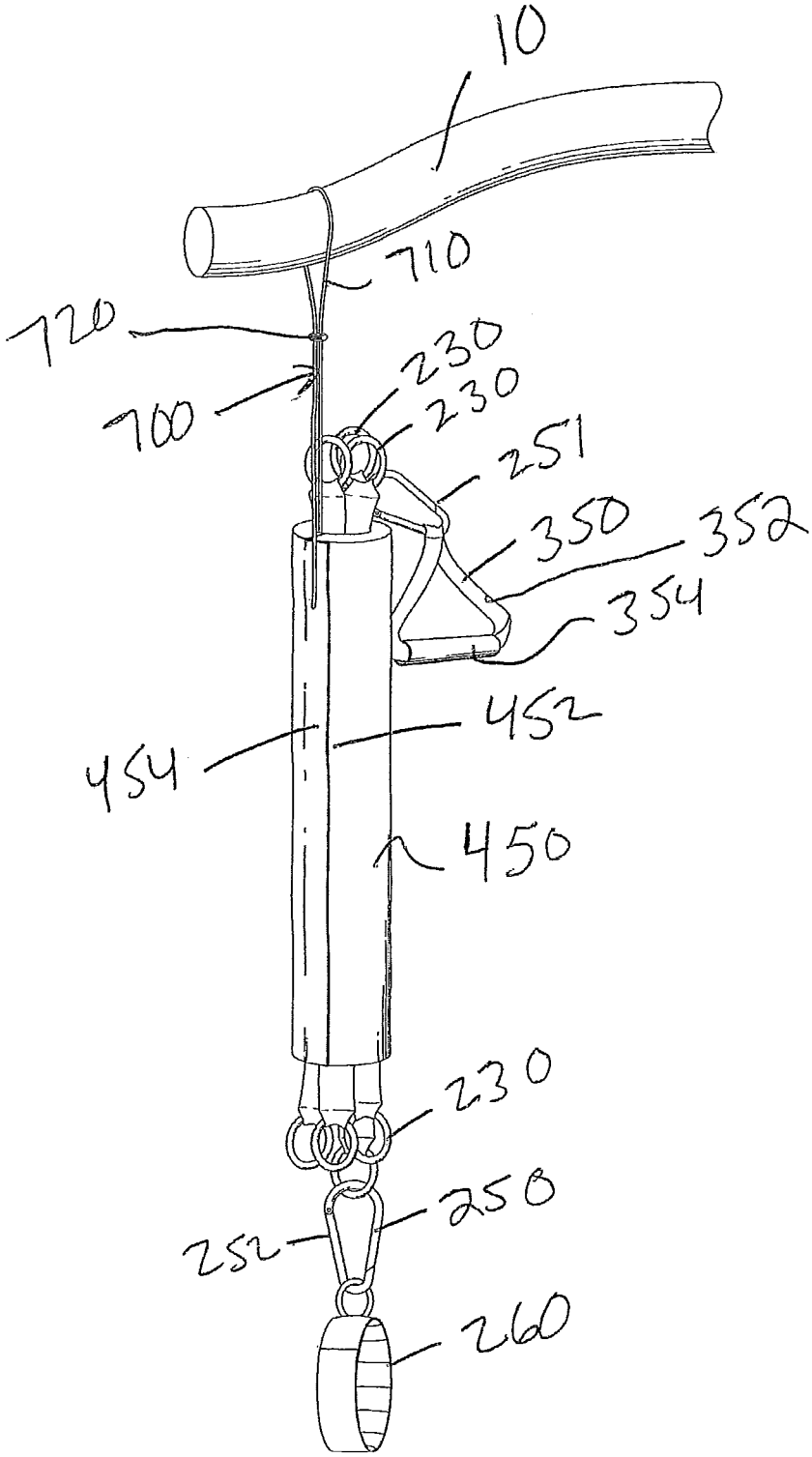
FIG. 6 is perspective view of a portable modular exercise device of FIG. 1 with an optional means for suspending the device by hanging/attachment to a support structure in a manner that permits the user to use the exercise device.

FIG. 6 shows a means 700 for supporting and optionally storing the exercise device made in accordance with the present invention. The means 700 can in the form of an adjustable cord 710 that is attached at least one end thereof to one end of the sleeve 450. The cord 710 is looped and extends back through an adjustable cinch member (fastener) 720 that allows the size of the loop to be varied and fixed or locked in place. For example, both cords sections that form the loop are fed through the cinch member 720. The cinch member 720 is removable from the cord 710 and is adjustable along the length of the cord 710 by simply moving the cinch member 720 therealong to either tighten or loosen the loop. The loop is tightened about the support structure 10 which can be in the form of a piece of equipment.

In accordance with the present invention, the means 700 allows the other end of the sleeve to be secured in place while the exercise device is being used. For example, when the device is attached to a piece of equipment, one end of the sleeve 450 is attached to the equipment by means of the fastener 260, while the other end is attached to a different location of the equipment or even a different support structure by the means 700. This allows the main portion (the sleeve and nested cords) of the device to be secured and held generally in place during use and allows the user to let go of the accessory (handle) and then easily regrasp the accessory since the accessory is disposed within easy reach of the user due to the suspended nature of the device. The user can adjust the hanging (suspended) position of the sleeve by adjusting one or more of the location of the fastener 260 and length of the cord 710.

In addition, the product can even be hung on the support structure when not in use.

It will also be appreciated that the sleeve 450 can serve to hold the bands 200, 210, 220 as by folding the ends of the bands 200, 210, 220 internally into the interior of the sleeve 450, thereby forming a compact storage unit in which the bands 200, 210, 220 are stored. This allows for easy transportation thereof.

It will be appreciated that the exercise devices disclosed herein can come in any number of different lengths depending upon the intended application. For example, the a longer length version can be provided for use on exercise equipment, similar to the arrangement shown in FIG. 5; and a shorter length version can be provided for use with the belt 500 of FIG. 3.

There are a number of advantages provided by the exercise devices according to the present invention including the following. The exercise devices are designed for use on, and easy installation and removal on, multiple exercise devices and in multiple locations. For example, the exercise devices can be used in combination with exercise machines (e.g., treadmill, elliptical machine, stationary bicycle (recumbent and upright), stair climbing machines, etc.); the devices can be used on a person (e.g., on ankles for stationary exercise, on a belt for stationary, jogging, running, sparring, and other moving exercise); and at stationary locations (e.g., exercise bench in reclining and non-reclining positions, etc.).

Another advantage of the present exercise devices is that they utilize multiple, easily interchangeable resistance bands. The bands can be used independently or collectively in any combination safely and easily without stopping during the same workout. In addition, the handle that is used with the device can have an optional cover which permits the use of multiple bands with one padded handle. Bands can be used singly, or in any combination, with or without the padded cover.

In addition, it will be appreciated and understood that the fastening devices and techniques shown herein for attaching the resistance band to the main fastener 260 and to the handle (s) are merely exemplary in nature and are not limiting of the present invention since other fasteners can be used to accomplish the same.

The invention is described in detail with reference to a particular embodiments thereof, but the scope of the invention is to be gauged by the claims that follow and also by those modifications that provide equivalent features to those that are claimed as such modifications are still within the spirit and scope of the invention.

What is claimed is:

1. An exercise device comprising:

at least one elongated elastic band, the band having a first end and an opposing second end; and a sleeve that receives at least a portion of each elastic band so as to at least partially envelope the elastic band while permitting the first and second ends to be accessible at ends of the sleeve, wherein the sleeve is openable along its length so as to permit the elastic band to be inserted and removed from the sleeve, wherein the sleeve includes a longitudinal slit that defines a first longitudinal edge and an opposing second longitudinal edge that are openable with respect one another to allow the elastic band to be inserted and removed from the sleeve;

wherein the first end of the elastic band is connected to a first fastener that is adjustable to allow secure attachment to another object, wherein the first fastener has a fastening element that allows a dimension of the first fastener to be varied so as to allow one of a plurality of fastener positions to be selected and locked in place, thereby securely attaching the first fastener to the object.

2. The exercise device of claim 1, wherein the first and second longitudinal edges are closed with respect to one another when the sleeve is in a closed position.

3. The exercise device of claim 2, wherein the sleeve includes complementary fasteners for securely closing the first longitudinal edge with respect to the second longitudinal edge.

4. The exercise device of claim 1, wherein the longitudinal slit extends an entire length of the sleeve.

5. The exercise device of claim 1, wherein the sleeve contains a plurality of elongated elastic bands.

6. The exercise device of claim 1, wherein the first end of the elastic band is configured to mate with a first fastener for attaching the first end of the elastic band to a support member.

7. The exercise device of claim 6, wherein the first end of the elastic band has a looped structure configured to mate with the first fastener.

8. The exercise device of claim 6, wherein the second end of the elastic band is configured to mate with an exercise accessory.

9. The exercise device of claim 1, wherein the sleeve contains two or more elastic bands, each elastic band having a connector to attach to the first fastener, the first fastener being configured to allow the connector to be detachable therefrom so as to select elastic bands to be attached to the first fastener.

10. An exercise device comprising:

at least one elongated elastic band, the band having a first end and an opposing second end;

a sleeve that receives at least a portion of each elastic band so as to at least partially envelope the elastic band while permitting the first and second ends to be accessible; and a first fastener that is coupled to the sleeve for suspending the sleeve by being attached to an object, the first fastener being a looped structure that has an adjustable length to allow a distance between the sleeve and the object to be varied and includes a locking mechanism to fix the first fastener at a selected length, thereby fixing the distance between the sleeve and the object;

wherein the first fastener comprises a cord that is looped and the locking mechanism comprises a cinch member that receives the looped cord and permits a size of the loop to be varied and fixed in place.

11. The exercise device of claim 10, wherein the sleeve is openable along its length so as to permit the elastic bands to be inserted and removed from the sleeve, wherein the sleeve includes a longitudinal slit that defines a first longitudinal edge and an opposing second longitudinal edge.

12. The exercise device of claim 11, wherein the first and second longitudinal edges are closed with respect to one another when the sleeve assumes a closed position.

13. The exercise device of claim 12, wherein the sleeve includes complementary fasteners for securely closing the first longitudinal edge with respect to the second longitudinal edge.

14. The exercise device of claim 10, wherein the sleeve contains a plurality of elongated elastic bands.

15. An exercise device comprising:

at least one elongated elastic band, the band having a first end and an opposing second end;

a sleeve that receives at least a portion of each elastic band so as to at least partially envelope the elastic band while permitting the first and second ends to be accessible; and a first fastener that is coupled to the sleeve for suspending the sleeve by being attached to an object, the first fastener being a looped structure that has an adjustable length to allow a distance between the sleeve and the object to be varied and includes a locking mechanism to fix the first fastener at a selected length, thereby fixing the distance between the sleeve and the object, wherein the first end of the elastic band is configured to mate with a first fastener for attaching the first end of the elastic band to a support member, wherein the first end of the elastic band has a looped structure configured to mate with the first fastener.

16. The exercise device of claim 15, wherein the first fastener is openable and closeable and adjustable along at least one dimension so as to permit the first fastener to attach to different sized support members, wherein the first fastener is detachably coupled to the first ends of the elastic bands.

17. The exercise device of claim 16, wherein the object and support member are the same.

* * * * *